United States Patent [19]

Moyer et al.

[11] 4,037,684

[45] July 26, 1977

[54] MOBILE LIFT APPARATUS WITH ELECTRIC POWER SYSTEM

[75] Inventors: Richard A. Moyer, Lansdale; Joseph D. Patton, Chalfont, both of Pa.

[73] Assignee: Asplundh Tree Expert Company, Willow Grove, Pa.

[21] Appl. No.: 635,222

[22] Filed: Nov. 25, 1975

[51] Int. Cl.[2] ..... B66F 11/04

[52] U.S. Cl. ..... 182/2; 182/19; 180/65 R; 180/82 R

[58] Field of Search ..... 182/2, 141, 148, 19, 182/18; 180/82 R, 103 R, 111, 112, 113, 65 R, 77 S, 77 R

[56] References Cited

U.S. PATENT DOCUMENTS

| | | | |
|---|---|---|---|
| 2,836,467 | 5/1958 | Myers | 182/2 |
| 3,016,973 | 1/1962 | Williamson | 182/148 |
| 3,043,395 | 7/1962 | Volkel | 182/2 |
| 3,095,945 | 7/1963 | Mitchell | 182/148 |
| 3,788,425 | 1/1974 | Balogh | 182/2 |
| 3,904,947 | 9/1975 | Crews | 180/65 R |

*Primary Examiner*—Reinaldo P. Machado
*Attorney, Agent, or Firm*—John W. Logan, Jr.

[57] ABSTRACT

The preferred embodiment of the invention disclosed in this application includes a vehicle having an engine and carrying a lift apparatus including a boom assembly and hydraulic motors operatively associated with a hydraulic control system for selectively operating the motors to raise and lower the boom. Included in the hydraulic control system is an electric motor and a pump, the former driving the latter and being energized by an electric power system including battery means in series with the motor. Between the battery and the motor there is provided switch means operatively associated with valve actuating members used for the selective operation of the hydraulic control system so that when any valve actuating member is moved to a position operating the hydraulic control system, it simultaneously actuates the switch means closing the circuit between the battery and the motor. Also included in the electric power system is a master switch preventing simultaneous operation of the vehicle engine and the electric power system.

9 Claims, 1 Drawing Figure

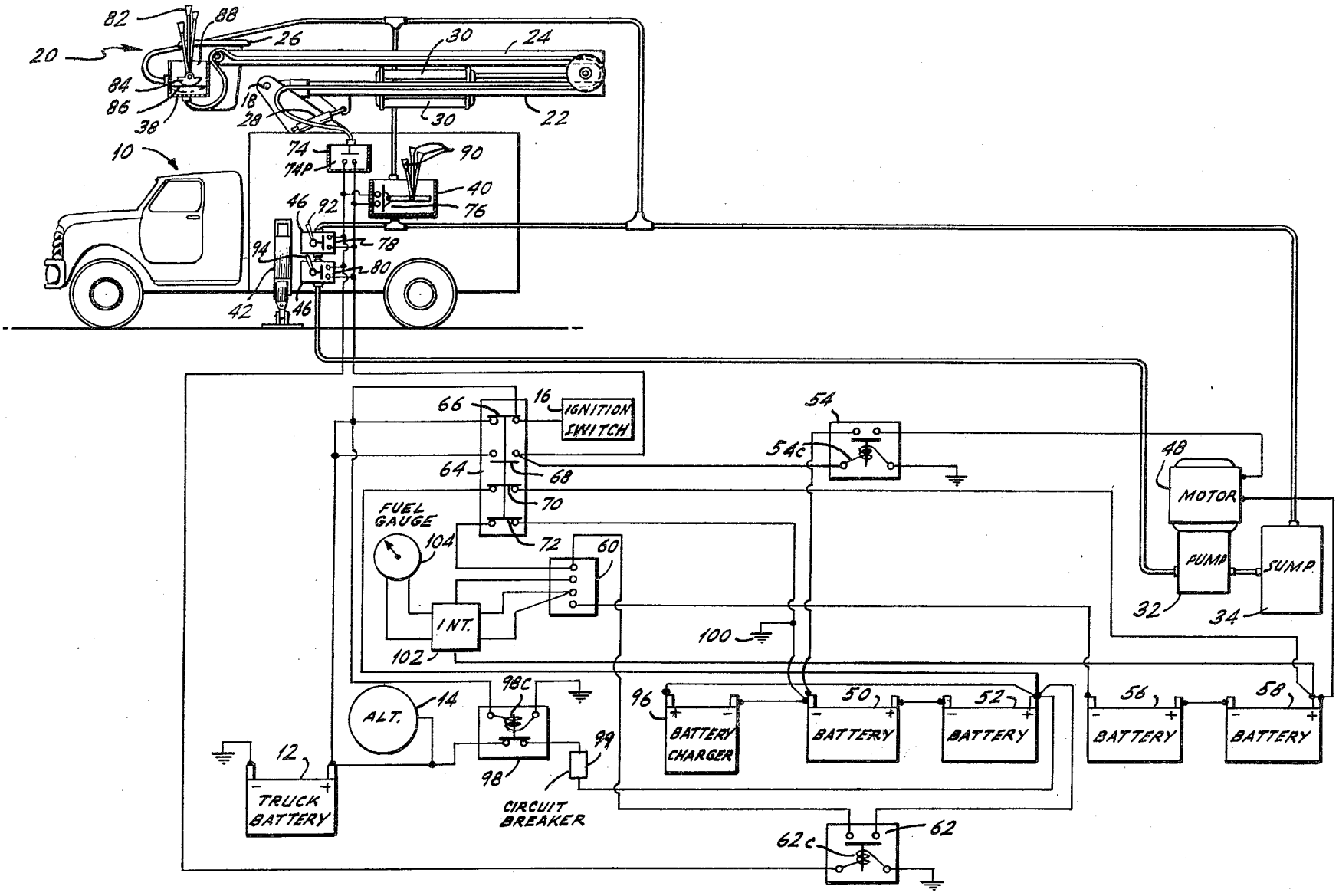
SUMP
MOTOR
PUMP
BATTERY
BATTERY
BATTERY
BATTERY
BATTERY CHARGER
IGNITION SWITCH
FUEL GAUGE
INT.
ALT.
CIRCUIT BREAKER
TRUCK BATTERY
TMP

MOBILE LIFT APPARATUS WITH ELECTRIC POWER SYSTEM

The invention disclosed herein relates to work apparatus carried on a vehicle and associated with a hydraulic control system and, more particularly, to an electric power system providing a power source for the hydraulic control system.

In various mobile hydraulically controlled work apparatus, for example, mobile lift systems for the type carried on a vehicle and including a hydraulic control system to lift an operator from the ground to an elevated work station, it has been usual to use the vehicle engine as a power source for the motor driving the pump in the hydraulic control system. Consequently, in mobile lift systems of the type described, the vehicle engine is in almost continuous operation since it functions to drive the vehicle and also as a power source when the lift system is in operation, a period when the vehicle is not usually driven. As a result of the continuous operation of the vehicle engine, several disadvantages are inherent in mobile lift apparatus of the type described. First, gasoline or other fuel used for the vehicle engine is wasted when the vehicle is standing idle and does not require power. With the increased cost of such fuels the operating expense of the apparatus is significantly increased. Second, exhaust emissions from the vehicle engine are unnecessarily discharged to the atmosphere when the vehicle is standing idle. These unnecessary emissions contribute to the air pollution problem. Third, the noise of the vehicle engine can be detrimental to the operators of the truck and lift apparatus. Fourth, use of the vehicle engine when the vehicle is standing idle results in unnecessary wear which may require costly maintenance and/or premature replacement.

Accordingly, it is an object of this invention to provide a vehicle carried, hydraulically operated work system that does not use the vehicle engine as a power source.

It is a further object of this invention to provide a vehicle carried, hydraulically operated lift apparatus having an electric power source.

It is yet another object of this invention to provide a vehicle carried, hydraulically operated lift apparatus having an electric power source the operation of which automatically precludes the operation of the vehicle engine.

Finally, it is an object of this invention to provide an electric power source for vehicle carried, hydraulically operated work systems that is easily rechargeable, economical and relatively inexpensive to install and operate.

These and other objects of this invention are accomplished by providing a vehicle including an engine and a lift apparatus having a hydraulic control system including an electrically operated motor for driving a pump. Further included is an electric power system for energizing the motor when operating the hydraulic control system. The electric power system includes battery means in series with the motor and switch means between the battery means and the motor and operatively associated with the valve actuators in the hydraulic control system whereby the valve actuators actuate the hydraulic control system and close the switch means to energize the motor. The electric power system further includes master switch means for precluding operation of the vehicle engine and the hydraulic control system simultaneously.

In accordance with the invention, the switch means between the battery means and the motor includes a relay switch which is energized from the vehicle engine battery. The master switch means includes first and second switches operative simultaneously with the first switch being in the vehicle ignition circuit and the second switch being between the vehicle engine battery and the relay. The first and second switches are arranged such that when one is open the other is closed and, accordingly, the vehicle engine cannot operate simultaneously with the hydraulic control system.

Also in accordance with the invention, the switch means also includes a pressure responsive switch between the second switch and the relay. The pressure responsive switch is in fluid communication with valve actuator means located at the operator's station in the lift assembly and the valve actuator means is arranged such that use of the valve actuator to operate the hydraulic control system also closes the pressure responsive switch to complete the circuit between the vehicle engine battery and the relay and, thus, between the battery means and the motor.

Preferably an override switch means is in parallel with the pressure responsive switch means and is operatively associated with override valve actuators located at the side of the vehicle for emergency use. Also, means is preferably provided for recharging the battery means from the vehicle engine and the electric power system includes charger means for recharging the battery means from an external power source. It has also been found desirable to provide measuring means for determining the amount of charge in the battery means and providing an indication thereof.

For a better understanding of the principles of the invention, reference is made to the following description of a preferred embodiment along with the accompanying drawing illustrating a vehicle having a lift apparatus with a hydraulic control system, shown schematically, and an electric power system, also shown schematically.

Referring to the drawing, there is illustrated a vehicle 10 in the form of a truck having an internal combustion engine (most of which is not shown) which includes a batter 12, an alternator 14, and an ignition circuit 16 as is generally conventional in the art. The vehicle engine is a generally conventional internal combustion engine and only the battery, alternator and ignition circuit are illustrated to facilitate an understanding of the invention. The truck includes an open bed on which is mounted a hydraulically controlled lift apparatus or any other suitable hydraulic work apparatus. In the preferred embodiment disclosed herein, the lift apparatus includes a vertically extending support member 18 about which an extensible boom assembly 20 is rotatably mounted in a conventional manner. The boom assembly 20 includes a first mast section 22 pivoted at one end about a horizontal axis adjacent the support member 18 and a second mast section 24 pivoted about a horizontal axis at one end of the first mast section. On the free end of the second mast section 24 is a bucket member 26 in which an operator or other workman can stand and be transported from the ground level to an elevated work station as the mast sections are pivoted about the horizontal axes. The first mast section 22 is pivoted about its horizontal axis by a hydraulic motor 28 in the form of a piston-cylinder arrangement and the second mast section 24 is pivoted about its horizontal axis by a pair of hydraulic motors 30 also in the form of piston-cylinder arrangements. For operating the hydraulic motors 28 and 30, there is provided a hydraulic control system including a pump 32 in communication with a pump 34 for pumping hydraulic fluid from the sump to the hydraulic motors. Between the pump 32 and the hydraulic motors 28 and 30 there are provided a plurality of control valve actuator systems 38 and 40 each operative to selectively actuate the motors. The actuator system 38 is located in the bucket 26 so that the operator-workman can control the operation of the lift assembly. The actuator system 40 is located at a convenient location on the truck so that operation of the lift assembly can be controlled from the ground in the event of an emergency and, thus, functions primarily as an override system.

As is usual in apparatus of this type, there are provided a pair of out-riggers 42, only one of which can be seen in the drawing, for stabilizing the truck 10 when the lift assembly 20 is operative. The out-riggers 42 are generally conventional apparatus and each includes a hydraulic motor (not shown) in the form of a piston and cylinder arrangement operative to move the out-riggers from a stored position within the truck to a position in engagement with the ground for providing stability. Operation of the hydraulic motors is controlled by control valve actuator systems 46, 46 one for each out-rigger 42 which control a valve that selectively allows or prevents communication between the pump 32 and the motors. At this point it is noted that hydraulic connections, not shown for the sake of clarity, are included between the actuator systems 38, 40 and 46 and the various hydraulic motors and from the control valve actuators to the sump.

The pump 32 is operatively connected to an electric motor 48 which provides an output driving the pump. The motor 48 is energized by an electric power system including storage battery means connected in series with the motor. Preferably, the battery means includes a first pair of series connected batteries 50 and 52 connected to the motor 48 through a motor relay 54 and a second pair of series connected batteries 56 and 58 which are connected in series to the first pair of batteries 50 and 52 through a shunt 60 and a battery relay 62. As should be clear, when the motor relay 54 and the battery relay 62 are closed the motor 48 is energized by the battery means and drives the pump 32.

It is noted that the electric power system also includes master switch means 64 which in the preferred embodiment disclosed herein includes a first switch 66, a second switch 68, a third switch 70 and a fourth switch 72. The switches 66, 68, 70 and 72 are ganged together for simultaneous operation such that when switches 66, 70 and 72 are closed, the switch 68 is open and when the switch 68 is closed, the switches 66, 70 and 72 are open. The master switch means 64 can be physically mounted in the cab of the truck for operation by a key or in any other convenient location. The second switch 68 is connected in series with the truck engine battery 12 and in parallel with the energizing coils **54*c* and 62*c* of the motor relay 54 and the battery relay 62. The connection from the switch 68 to the motor relay coil 54*c* is direct, so that when the second switch 68 is closed the motor relay coil 54*c* is energized by the truck engine battery 12 and motor relay 54 is also closed. The connection between the switch 68 and the battery relay coil 62*c* is across four parallel switches 74, 76, 78 and 80. Accordingly, when any of the switches 74, 76, 78 or 80 is closed the battery relay coil 62*c* is energized by the truck engine battery 12 and the relay 62 is closed completing the series circuit between the batteries 50, 52, 56 and 58 and the motor 48.**

The switch 74 is in the form of a pressure responsive switch including a pressure chamber **74*p* in which the switch member is carried. The pressure chamber 74*p* is in closed communication with the valve actuator system 38 located in the basket 26. The switch 74 is physically located on the support member 18 and the communication between the pressure chamber 74*p* and the actuator system 38 is through an air hose A extending from the pressure chamber along the first and second mast sections 22 and 24, respectively. The actuator system 38 includes a plurality of valve actuating members 82 operative to selectively actuate different control valves. Each of the actuating members 82 is formed on the lower end with a cam 84 which bears on a flexible diaphragm 86 carried in a pressure chamber 88. When any of the actuator members 82 is moved to a position actuating a control valve, the cam 84 flexes and depresses the diaphragm 86 displacing air through the air hose A into the pressure chamber 74*p*. The additional air in the pressure chamber 74*p* increases the pressure therein causing the switch member to close the circuit between the switch member 68 and the battery relay coil 52*c*. The desired arrangement provides for the simultaneous actuation of the appropriate control valve in the hydraulic system and also the pump. In addition, no electric wiring along the boom assembly 20 or bucket 26** is required which would present insulation problems.

The switch 76 is in the nature of an override switch in the event of a malfunction or emergency necessitating operation of the hydraulic control system from the ground and includes a switch member mechanically connected to the valve actuating members 90 which operate the override actuator system 40. Thus, use of any of the actuator members 90 will automatically override the actuator system 38 and will simultaneously close the circuit between the switch member 68 and battery relay coil **62*c*** permitting operation of the hydraulic control system.

The switches 78 and 80 include switch members mechanically connected to valve actuating members 92 and 94, respectively which operate to control actuator systems 46, 46 for the outriggers 42, 42. Thus, use of actuating members 92 and 94 which operate the control valves in the actuating system 46 automatically closes the associated switch 78 or 80 and completes the circuit between the switch 68 and the battery relay coil **62*c* providing an output from the battery system to the motor 48 and the pump 32** to actuate the appropriate outrigger motor.

At this point, it is noted that the first switch 66 included in the master switch means 64 is in series with the ignition circuit 16 and the vehicle engine battery 12. As noted previously, when the first switch 66 is closed, the second switch 68 is open and when the second switch is closed, the first switch is open. Accordingly, the vehicle engine ignition circuit is disconnected when the batteries 50, 52, 56 and 58 are connected to the motor 48 and the vehicle engine and the electric motor 48 cannot operate simultaneously. With this arrangement, the advantages provided by this invention are automatically realized and cannot be obviated through oversight on the part of the operators in not turning off the vehicle engine when using the lift assembly 20.

For recharging, the batteries 50, 52, 56 and 58 are connected in parallel pairs, the first pair being batteries 50 and 52, the second pair being batteries 56 and 58. The parallel connection is through the third and fourth switches 70 and 72 in the master switch means 64. As shown in the drawing the third switch 70 is between the positive sides of the first pair 50, 52 and the second pair 56, 58 of batteries and the fourth switch 72 and the shunt 60 are between the negative sides of the first pair and the second pair of batteries. As noted previously, when the switches 70 and 72 complete the parallel circuit between the first and second pairs of batteries are closed, the second switch 68 is open so that the relays 54 and 62 are inoperative and the series circuit between the batteries 50, 52, 56 and 58 and the motor 48 is open. A battery charger 96 is connected across the first and second pair of batteries and battery charger 96 is a generally conventional apparatus adapted to be connected to an external power source for recharging the batteries.

The batteries 50, 52, 56 and 58 can also be recharged from the truck alternator 14 during operation of the vehicle engine. Accordingly, the truck alternator 14 which is connected to recharge the vehicle engine battery 12 in a conventional manner is also connected to the electric power system batteries 50, 52, 56 and 58. As explained previously, when the switches 70 and 72 are closed the first pair of batteries 50, 52 and the second pair of batteries 56 and 58 are connected in parallel with each other and with the vehicle engine battery 12 so that all of the batteries can be recharged when the vehicle engine is operating. To isolate the vehicle engine battery 12 from the power system batteries 50, 52, 56 and 58 and prevent damage a battery protector system is provided and includes a charging relay 98 and a circuit breaker 99 connected in series between the alternator 14 and the same side, that is, the positive side of the first and second pair of batteries. The charging relay coil **98*c* is connected to the vehicle engine battery 12 through the switch 66 so that when the switch 66 is open preventing operation of the vehicle engine and allowing operation of the electrical power system, the charging relay is also open. With the charging relay 98 open, the vehicle engine battery 12 and the alternator 14 are isolated from the batteries 50, 52, 56 and 58. When the switch 66 is closed, the batteries 50, 52, 56 and 68 are connected in parallel, as explained, and the vehicle engine battery 12 energizes the charging relay coil 98*c* causing the relay 98 to close. Thus the alternator 14 can recharge the electrical power system batteries 50, 52, 56 and 58**.

Finally, the electric power system includes an arrangement for determining and indicating the amount of charge in the electric power system batteries 50, 52, 56 and 58. In the preferred embodiment of the invention disclosed herein, a generally conventional voltage-time integrator 102 is connected to the shunt 60 and also to the battery 58 so that it measures the discharge of the batteries 50, 52, 56 and 58 when energizing the motor 48 or the charge induced in the batteries when connected to either the battery charger 96 or the truck alternator 14. The voltage time integrator 102 provides an output to an indicator 104 which is preferably located in the cab of the truck so that the amount of energy in the batteries can always be determined. The voltage-time integrator 102 and the indicator 104 are generally conventional apparatus and can be purchased from Curtis Instrument Company and others.

From the preceding, operation of the system in accordance with this invention can now be understood. Initially, when the vehicle 10 is to be transported to a job site the master switch is set as illustrated in the drawing with the switches 66, 70 and 72 closed and with the switch 68 open. With the switch 68 open, the relay coils **54*c* and 62*c* are not energized and the associated relays are open so that the motor 48 cannot be energized. With the switch 66 closed, the ignition circuit is closed so that the vehicle engine can function in a normal manner. Also, with the switches 70 and 72 closed the batteries can be charged from the truck alternator 14 as explained previously. When the job site is reached, and it is desired to use the lift apparatus, the master switch 64 must be operated such that the switches 66, 70 and 72 are open and the switch 68 is closed. With the switch 66 open, the ignition circuit is open and the vehicle engine cannot be utilized. Also, with the switches 70 and 72 open, the parallel circuit between the first pair 50, 52 and the second pair 56, 58** of batteries is disconnected.

As explained previously, with switch 68 closed, the truck battery 12 energizes the motor relay coil **54*c* closing the relay 54. Next, it is usual to operate the outriggers 42 to stabilize the truck. Thus, the actuators 92 and 94 are operated in sequence to set the control valve for operating the outrigger motors and extending the outriggers 42. Simultaneous with the use of the actuators 92 and 94, the switches 78 and 80 are closed completing the circuit from the battery 12 through the switch 68 to the battery relay coil 52*c*. When this circuit closes, the batteries 50, 52, 56 and 58 discharge through the motor, energizing the motor and operating the pump to provide the hydraulic fluid through the control valve to the outrigger motors. When the actuators 92 and 94 return to their original position, the circuit between the battery and the battery relay coil 62*c* is again open which discontinues the discharge of the batteries 50, 52, 56 and 58 to the motor 48**.

When the operator desires to raise the bucket 26 the appropriate valve actuator 82 is manipulated flexing the diaphragm 86 and closing the air switch 74. With the switch 74 closed, the circuit from the truck battery 12 through the switch 68 to the battery relay coil **52*c* is complete. As explained earlier, the batteries 50, 52, 56 and 58 discharge to the motor 48. Thus fluid is provided to the hydraulic motors 28 or 30. When the bucket 26 reaches the desired position, the actuator 82 is returned to a neutral position allowing the diaphragm 86 to relax and allowing the switch 74** to open so that the output from the batteries to the motor is discontinued.

In the event of an emergency, the override actuator 40 can be manipulated to override the hydraulic control system in the bucket 26 and at the same time, to close the switch 76 completing the circuit as explained previously.

While in the foregoing, a preferred embodiment of the invention has been described, it should be obvious to one skilled in the art that various modifications and changes can be made within the true spirit and scope of the invention as recited in the appended claims.

We claim:

1. In combination a vehicle including an engine and a lift apparatus, said lift apparatus being operatively associated with a hydraulic control system inluding valve actuator means for controlling the operation of said hydraulic control system, said lift apparatus further including an electric motor operatively connected with pump means in said hydraulic control system and an electric power system for energizing said electric motor, said electric power system including battery means in series with said electric motor and switch means between said battery means and said electric motor, said switch means being operatively associated with said valve actuator means, said switch means being open when said valve actuator means is in an inoperative position and being movable to a closed position when said valve actuator means is operative, said electric power system further including master switch means for preventing the simultaneous operation of said vehicle engine and said electric motor.

2. The combination recited in claim 1 wherein said switch means includes a relay between said battery means and said motor, said relay being energized by the battery associated with said vehicle engine, said master switch means including first and second switches, said first switch being in series with the ignition circuit of said vehicle engine and said second switch being in series with said battery associated with said vehicle engine and said relay, said first and second switches being arranged such that when one is open, the other is closed.

3. The combination recited in claim 2 wherein said switch means includes a switch in series with said second switch and said relay, said switch being operative by said valve actuator means.

4. The combination recited in claim 1 wherein said valve actuator means includes a plurality of valve actuator systems, one of said valve actuator systems being located on said lift apparatus and another valve actuator system being located on said vehicle and being arranged to override said one valve actuator system, said switch means including first and second switches in parallel, said first switch being operative with said one of said valve actuator systems and said second switch being operative with said another valve actuator systems.

5. The combination recited in claim 1 wherein said lift apparatus includes an operator's station at which said valve actuator means is located, said switch means including a pressure response switch in communication with said valve actuator means whereby operation of said valve actuator means increases the pressure on said pressure responsive switch.

6. The combination recited in claim 1 wherein said battery means includes at least two batteries and including battery charger means adapted to be connected to an external power source for recharging said batteries, said master switch means including switches for connecting said batteries in parallel when said batteries are being recharged.

7. The combination recited in claim 1 wherein said battery means includes at least two batteries arranged to be recharged from an alternator in said vehicle engine, said master switch means including switches for connecting said batteries in parallel when said batteries are being recharged.

8. The combination recited in claim 7 wherein a relay is connected between said alternator and said battery means, said relay being energized by a battery associated with said vehicle engine and being selectively connected or disconnected to said vehicle engine battery by a switch.

9. The combination recited in claim 1 including measuring means for determining the charge in said battery means and providing an indication thereof.

* * * * *

UNITED STATES PATENT OFFICE

CERTIFICATE OF CORRECTION

Patent No. 4,037,684 Dated July 26, 1977

Inventor(s) Richard A. Moyer and Joseph D. Patton

It is certified that error appears in the above-identified patent and that said Letters Patent are hereby corrected as shown below:

Column 3, line 6, "pump" should be --sump--.

Column 4, line 28, "desired" should be --described--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*